United States Patent [19]

Neefe

[11] 3,955,225

[45] May 11, 1976

[54] UPHOLSTERED ARTICLE AND METHOD

[75] Inventor: Donald D. Neefe, Rochester, N.Y.

[73] Assignee: Sybron Corporation, Rochester, N.Y.

[22] Filed: Oct. 21, 1974

[21] Appl. No.: 516,384

[52] U.S. Cl. ..... 5/353.3; 297/452

[51] Int. Cl.[2] ..... A47C 7/02; A47C 23/00

[58] Field of Search ..... 5/353.1, 353.2, 353.3, 5/353.4, 353.6, 353.5, 353.7, 353.8; 297/452, 458, 461; 160/388, 402, 389; 29/91.1, 91.5

[56] References Cited

UNITED STATES PATENTS

| | | | |
|---|---|---|---|
| 805,204 | 11/1905 | Jackson et al. | 5/353.8 |
| 1,020,407 | 3/1912 | Foster | 5/353.1 |
| 1,454,577 | 5/1923 | Eyster | 5/353.7 X |
| 1,544,873 | 7/1925 | Trimble | 5/353.5 |
| 2,101,124 | 12/1937 | Young | 5/353.3 X |
| 2,215,318 | 9/1940 | Bristol | 29/513 X |
| 2,222,052 | 11/1940 | Vanderploeg | 5/353.1 |
| 2,322,836 | 6/1943 | Eady | 5/353.3 X |
| 2,896,696 | 7/1959 | Molla et al. | 160/385 |
| 3,117,819 | 1/1964 | Kudriavetz | 297/452 |
| 3,174,797 | 3/1965 | Neufeld | 5/353.1 X |
| 3,179,469 | 4/1965 | Heuston | 5/353.7 X |
| 3,574,401 | 4/1971 | Lehner | 297/452 X |
| 3,765,039 | 10/1973 | Ewoldt | 5/353.1 |
| 3,842,456 | 10/1974 | Bronstien | 5/353.1 |

FOREIGN PATENTS OR APPLICATIONS

| | | | |
|---|---|---|---|
| 583,811 | 10/1958 | Italy | 5/353.3 |
| 984,645 | 3/1965 | United Kingdom | 5/353.2 |
| 606,329 | 11/1948 | United Kingdom | 5/353.8 |
| 22,578 | 1/1962 | Germany | 297/452 |
| 78,155 | 5/1962 | France | 160/385 |

*Primary Examiner*—Roy D. Frazier
*Assistant Examiner*—Thomas J. Holko
*Attorney, Agent, or Firm*—Theodore B. Roessel; Roger Aceto

[57] ABSTRACT

An upholstered article and method in which a rigid pan to be upholstered is provided with a series of interior cutouts along an exterior edge, the cutouts defining an imitation interior edge to which is clipped, by metal clips, the upholstery material. The material is folded over the exterior edge and then into the cutouts over the interior imitation edge. This provides the pan with an upholstered exterior edge while maintaining a relatively thin profile of the upholstered article. Further, the upholstery material is provided with a series of tabs which are folded into the cutouts, the depth of the tabs defining a datum line to accurately position the material on the pan.

4 Claims, 3 Drawing Figures

UPHOLSTERED ARTICLE AND METHOD

BACKGROUND OF THE INVENTION

The present invention relates generally to an upholstered article and method of its manufacture and more specifically to the upholstering of an article having a rigid pan and a low profile.

Various upholstered articles, such as dental chairs and the like, are formed by placing a cushion material on a rigid backing or pan and then overlaying the pan and cushion with an upholstery material. Various difficulties arise when attempting to attach the upholstery material to a metal pan. For example, it is not possible to staple the material to the pan and riveting or the use of snaps is expensive. Furthermore, it is difficult to glue the upholstery material to the pan because the resiliency of the cushion tends to pull the material from the pan unless a constant pressure is applied during the time the glue is setting. One prior art method for overcoming these difficulties is to provide the edge of the pan with a reverse bend as shown for example in figure labeled Prior Art. The upholstery material was then folded around the edged form by this bend and simply clipped into place with a spring metal clip. The reverse bend in the pan, however, inherently increases the thickness of the upholstered article so that this technique does not lend itself to a manufactured article having a relatively thin profile. Also, with this method, some degree of manual skill is required to properly position the upholstery material on and over the pan.

The present invention provides an upholstered article and method which can be used to produce relatively thin profiled articles and greatly reduces the amount of manual skill necessary to produce such an article.

SUMMARY OF THE INVENTION

The present invention may be characterized in one aspect thereof by an upholstered article and its method of manufacture wherein the article comprises a rigid pan to be upholstered, the pan having a plurality of spaced cutouts along an exterior edge thereof, the cutouts defining an interior edge to which the upholstery material is clipped; and an upholstery material having a plurality of corresponding tabs which are folded through the cutouts, over the interior edge and clipped into place with spring metal clips.

OBJECTS OF THE INVENTION

One object of the present invention is to provide an upholstered article having a relatively thin profile.

Another object of the present invention is to provide an upholstered article which is quickly and easily manufactured with a minimum of manual skill.

A further object of the present invention is to provide a method of manufacturing an upholstered article having a relatively thin profile.

These and other objects, advantages and characterizing feature of the present invention will become more apparent upon consideration of the following detailed description thereof when taken in connection with the accompanying drawings depicting the same.

DESCRIPTION OF THE PREFERRED EMBODIMENTS

Figure 1:
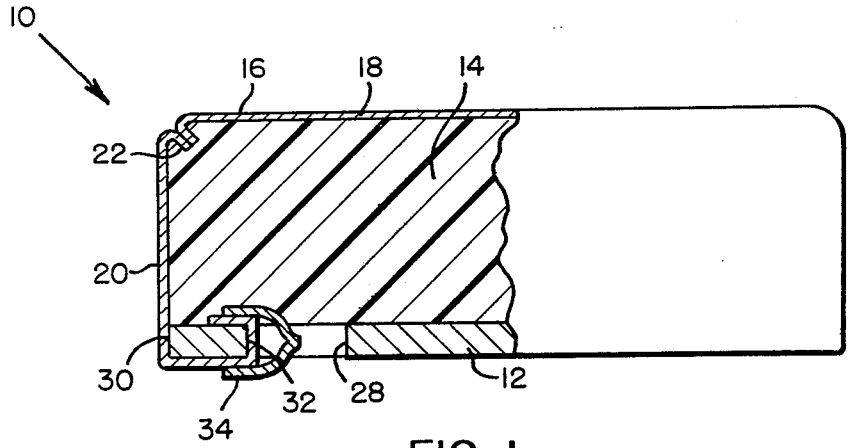
FIG. 1 is an elevation view partly broken away and in section showing a portion of upholstered article made in accordance with the present invention.
Figure 2:
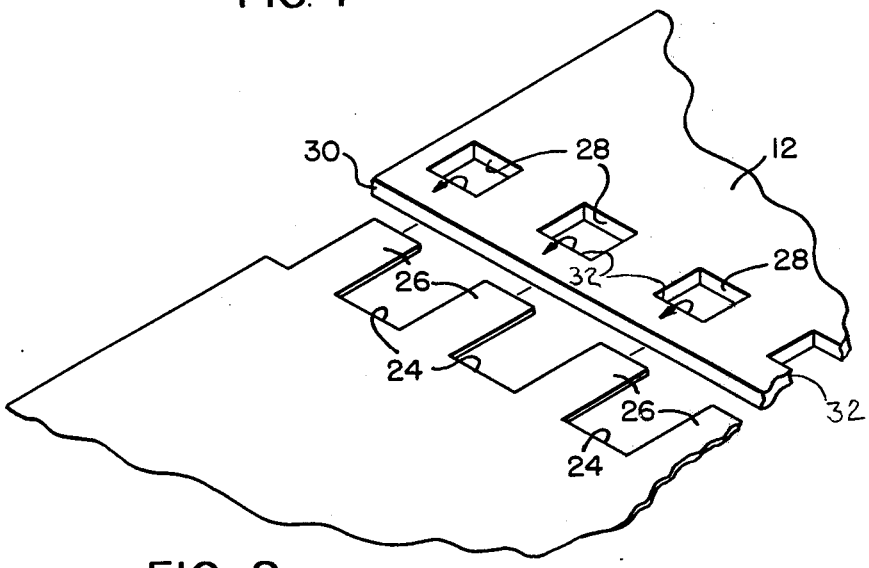
FIG. 2 is an exploded view in perspective showing portions of the article prior to assembly.

Referring to the drawings, FIG. 1 shows an upholstered article of the present invention generally indicated at 10. The article may be for example, a backrest portion of a dental chair and includes a rigid back or pan member 12. For dental chair applications, it is preferred that pan member 12 be metal in order to provide the characterics of being relatively thin, rigid, non-flamable and easily formed with any appropriate contour or curve to comfortably accomodate the human anatomy. A cushion 14, made from a suitable soft, resilient material such as foam rubber, is placed on the pan and the pan and cushion, then covered with a sheet of upholstery material 16. As shown in the figure, the upholstered material may be made in several sections such as a top section 18 and a side panel 20, which are stitched together along a sew line 22. In addition, the upholstery material 16 is provided with crenels 26 along at least one edge as best seen in FIG. 2. The crenels 26 are preferably uniformly spaced along the edge and are of substantially the same dimensions. The root of the crenellated edge, as indicated at 24, establishes a datum line for purposes set out herein below.

As also shown in FIG. 2, pan member 12 has a plurality of spaced openings 28 formed along a edge 30 thereof, the openings corresponding to crenels 26 on the upholstery material. With this arrangement the pan can be laid on the edge of the upholstery material and the crenels folded up through openings 28 as indicated by the arrows in FIG. 2 and over the internal edge 32 formed by the openings. Any suitable means, such as spring wire clamps 34 (FIG. 1) can then be used to clamp the crenels to edge 32. This provides the structure shown in FIG. 1, wherein the upholstery material covers the external edge 30 of the pan and is folded along a portion of the undersurface of the pan and up through opening 28, over the internal edge 32 and then down over the top surface of the pan, the material being clamped in position by the spring wire clamps 34.

Figure 3:
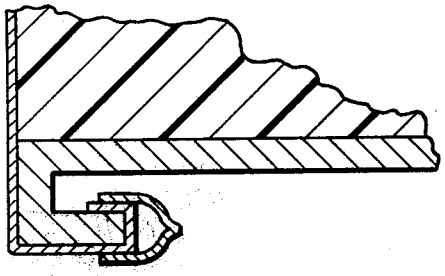
FIG. 3 (PRIOR ART)
FIG. 3 is labeled "Prior Art" and is a fragmentary view showing a portion of upholstered article as heretofore being manufactured.

As shown in FIG. 1, the spaced openings 28 provide an edge 32 to which the upholstery material may be clamped, this edge being adjacent and opposed to the upholstered edge 30. Provision of this clamping edge is accomplished by openings 28 in a manner which reduces the profile over the manner in which this is accomplished in the prior art as shown in FIG. 3.

As set out hereinabove, the root edge 24 of crenels 26 defines a datum line. By superimposing this datum line, on the line formed by the internal edges 32 of the openings, the material can be accurately positioned on the pan so that when the material is pulled up and over cushion 14 for attachment to the other side of the pan (not shown) there will be sufficient material available at the opposite end to accomplish a similar attachment to the pan.

Thus, it should be appreciated that the present invention accomplishes its intended objects in providing an upholstered article which is assembled with ease and which has a relatively thin profile. The method of manufacturing the article described herein, including the steps of crenelating the edge of the upholstered material and forming a series of spaced openings in the pan which correspond to the crenelations not only facilitates the assembly of the upholstered article but also provides a datum line for accurately positioning the material on the pan.

Having thus, described the invention in detail, what is claimed as new is:

1. An upholstered article comprising:

a. a rigid pan having a plurality of openings therethrough spaced along and adjacent at least one side thereof, said openings each having an edge which together define an discontinuous internal edge of said pan adjacent and extending substantially parallel to said one side;

b. a cushion piece on the upper surface of said pan, said cushion extending over said openings to said one side;

c. upholstery material overlaying said cushion piece and extending down over said one side, said material having a crenellated edge, the crenels thereof each extending over the lower surface of said pan and being folded up through said openings over said internal edge towards said one side and on to said upper surface of said pan;

d. said crenels each having a root edge which together define a discontinuous datum line, said discontinuous datum line and said discontinuous internal edge of said pan cooperating to provide means for properly positioning said upholstery material with respect to said pan wherein the proper positioning is obtained when said datum line is superimposed on said internal edge; and e. a spring wire clip for fastening each of said crenels to said internal edge.

2. An upholstered article as in claim 1 wherein said openings are substantially square, the width of each crenel being equal to the length of a side of said opening.

3. An upholstered article as in claim 1 wherein the space between crenels is equal to the space between said openings.

4. A method of making an upholstery article comprising:

a. forming a plurality of openings spaced along and adjacent at least one side of a rigid pan, the edge of each opening next adjacent said one side together defining an internal edge in said pan adjacent and extending substantially parallel to said one side;

b. laying a cushion material over said pan;

c. forming crenels in the edge of an upholstery material, the root edge of each crenel together defining a datum line;

d. laying said upholstery material over said cushion material and extending said upholstery material down over said one side of said pan and positioning said crenellated edge on the lower surface and said pan so as to superimpose said datum line on said internal edge;

e. folding said crenels up through each opening and back towards said one side of said pan over said internal edge and on to said front surface; and f. clamping said crenel to said internal edge.

* * * * *